US005215108A

United States Patent [19]

Sprague

[11] Patent Number: 5,215,108

[45] Date of Patent: Jun. 1, 1993

[54] TABLE AND CANOPY APPARATUS

[76] Inventor: John V. Sprague, P.O. Box 246, Lovell, Me. 04051-0246

[21] Appl. No.: 682,342

[22] Filed: Apr. 9, 1991

[51] Int. Cl.[5] ..... E04H 15/04

[52] U.S. Cl. ..... 135/90; 135/96; 135/106; 108/50

[58] Field of Search ..... 135/90, 88, 87, 96, 135/106, 109; 108/50, 150; 297/184

[56] References Cited

U.S. PATENT DOCUMENTS

| | | | |
|---|---|---|---|
| D. 290,315 | 6/1987 | Swenson | D6/337 |
| 2,161,658 | 6/1939 | Hansburg | 297/184 X |
| 2,434,685 | 1/1948 | Claus | 135/109 X |
| 2,508,757 | 5/1950 | Gray | 135/109 X |
| 2,618,285 | 11/1952 | Heisig | 135/90 |
| 2,790,452 | 4/1957 | Dusek | 108/42 X |
| 2,850,027 | 9/1958 | Smith | 135/109 X |
| 3,006,705 | 10/1961 | Williams et al. | 108/50 X |
| 3,221,756 | 12/1965 | Rupright | 108/50 X |
| 3,233,618 | 2/1966 | Ferrier | 108/50 X |
| 3,417,764 | 12/1968 | Hemenway | 108/50 X |
| 3,463,174 | 8/1969 | Heller | 135/109 |
| 4,077,418 | 3/1978 | Cohen | 135/109 X |
| 4,330,151 | 5/1982 | Healey . | |
| 4,621,865 | 11/1986 | Herrera . | |

FOREIGN PATENT DOCUMENTS

| | | | |
|---|---|---|---|
| 1078288 | 11/1954 | France | 108/50 |
| 335820 | 3/1959 | Switzerland | 108/50 |
| 2216850 | 10/1989 | United Kingdom | 135/90 |

*Primary Examiner*—Carl D. Friedman
*Assistant Examiner*—Lan M. Mai
*Attorney, Agent, or Firm*—Leon Gilden

[57] ABSTRACT

An apparatus wherein a fullness structure is extended and secured together for securement in association with a table to provide a canopy therefore. Left and right support posts mount a horizontal beam thereon. The horizontal beam mounts a plurality of first brace legs mounted between the beam and each post, with a foldable canopy framework mounted laterally of the horizontal beam, with plural pairs of second brace legs mounted diametrically opposed to one another relative to each post extending upwardly from each post and received within associated slots within each rectangular framework. A flexible covering is arranged for mounting overlying the rectangular frameworks. Further, the support posts are arranged for attaching to an associated table structure.

4 Claims, 5 Drawing Sheets

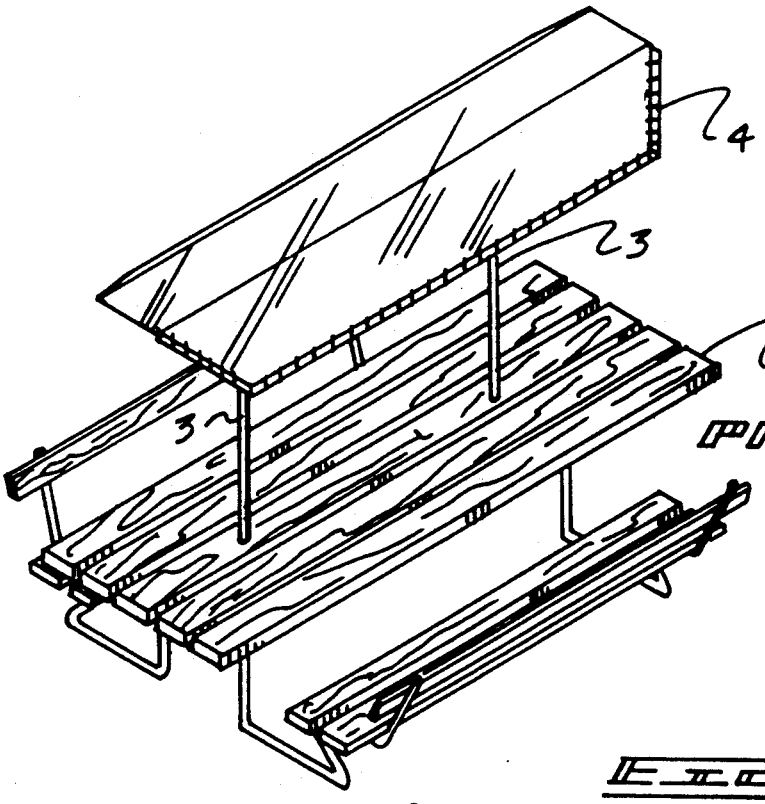
FIG 1
PRIOR ART
FIG 2
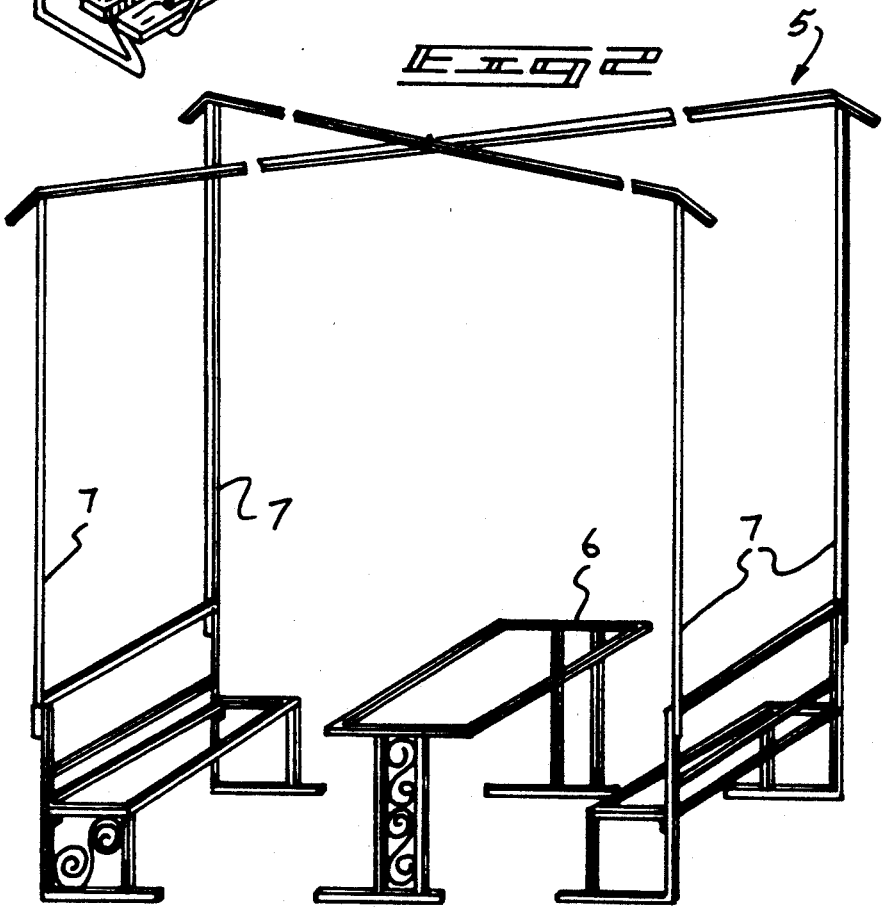
PRIOR ART

TABLE AND CANOPY APPARATUS

BACKGROUND OF THE INVENTION

1. Field of the Invention

The field of invention relates to canopy apparatus, and more particularly pertains to a new and improved table and canopy apparatus wherein the same is arranged for directing a structure in association with a table to effect an overlying canopy organization that may be interfolded for ease of storage and transport.

2. Description of the Prior Art

Various canopy structure has been set forth in the prior art to provide shade and protective covering from climactic elements. Examples of such may be found in U.S. Pat. No. 4,621,865 to Herrera wherein patio type furniture includes an "X" type framework overlying a central table.

U.S. Pat. No. De. 290,315 sets forth the use of a generally planar canopy overlying the table, with the canopy mounted to opposed support legs directed through the table.

U.S. Pat. No. 4,330,151 to Healey sets forth a multipurpose table, wherein the table is adjustable and utilizes telescoping framework portions for extension and positioning of the table relative to associated seat portions.

As such, it may be appreciated that there continues to be a need for a new and improved table and canopy apparatus as set forth by the instant invention which addresses both the problems of ease of use as well as effectiveness in construction in providing a convenient manner directing a canopy organization relative to an associated table.

SUMMARY OF THE INVENTION

In view of the foregoing disadvantages inherent in the known types of canopy apparatus now present in the prior art, the present invention provides a table and canopy apparatus wherein the same is extensible and arranged for securement to an associated table during use and may be overfolded relative to itself for ease of storage and transport. As such, the general purpose of the present invention, which will be described subsequently in greater detail, is to provide a new and improved table and canopy apparatus which has all the advantages of the prior art canopy apparatus and none of the disadvantages.

To attain this, the present invention provides an apparatus wherein a fullness structure is extended and secured together for securement in association with a table to provide a canopy therefore. Left and right support posts mount a horizontal beam thereon. The horizontal beam mounts a plurality of first brace legs mounted between the beam and each post, with a foldable canopy framework mounted laterally of the horizontal beam, with plural pairs of second brace legs mounted diametrically opposed to one another relative to each post extending upwardly from each post and received within associated slots within each rectangular framework. A flexible covering is arranged for mounting overlying the rectangular frameworks. Further, the support posts are arranged for attaching to an associated table structure.

My invention resides not in any one of these features per se, but rather in the particular combination of all of them herein disclosed and claimed and it is distinguished from the prior art in this particular combination of all of its structures for the functions specified.

It is therefore an object of the present invention to provide a new and improved table and canopy apparatus which has all the advantages of the prior art canopy apparatus and none of the disadvantages.

It is another object of the present invention to provide a new and improved table and canopy apparatus which may be easily and efficiently manufactured and marketed.

It is a further object of the present invention to provide a new and improved table and canopy apparatus which is of a durable and reliable construction.

An even further object of the present invention is to provide a new and improved table and canopy apparatus which is susceptible of a low cost of manufacture with regard to both materials and labor, and which accordingly is then susceptible of low prices of sale to the consuming public, thereby making such table and canopy apparatus economically available to the buying public.

Still yet another object of the present invention is to provide a new and improved table and canopy apparatus which provides in the apparatuses and methods of the prior art some of the advantages thereof, while simultaneously overcoming some of the disadvantages normally associated therewith.

Still another object of the present invention is to provide a new and improved table and canopy apparatus wherein the same sets forth a secure and readily interlocking association of components for presenting a canopy structure in association with a table.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a prior art table and canopy apparatus.

FIG. 2 is an isometric illustration of a further example of a prior art table and framework structure.

DESCRIPTION OF THE PREFERRED EMBODIMENT

Figure 3:
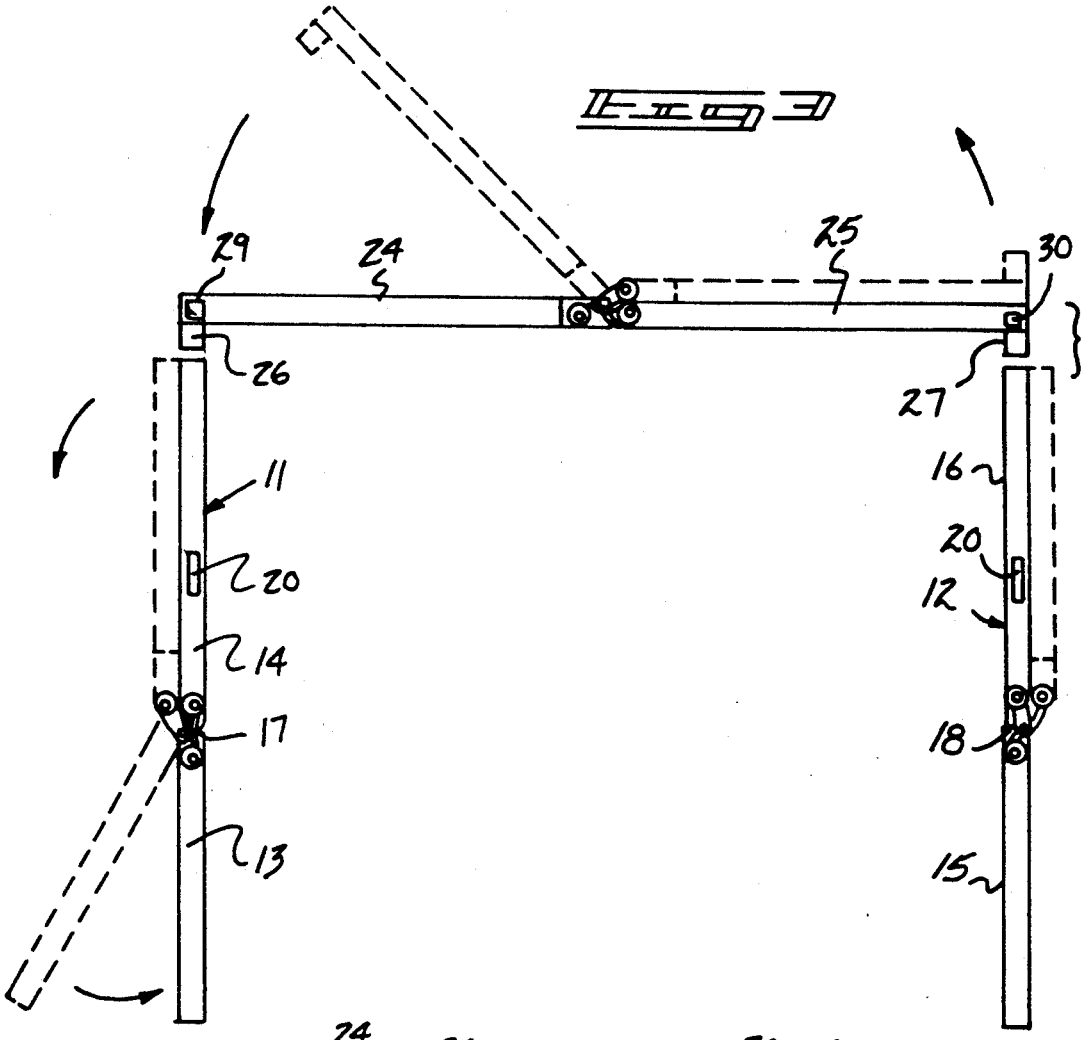
FIG. 3 is an orthographic side view, taken in elevation, of the instant invention in an initial partially erected configuration.

With reference now to the drawings, and in particular to FIGS. 1 to 10 thereof, a new and improved table and canopy apparatus embodying the principles and concepts of the present invention and generally designated by the reference numeral 10 will be described.

FIG. 1 illustrates a prior art table and canopy apparatus 1, wherein a table 2 mounts a plurality of vertical posts 3 therethrough to secure a canopy 4 at an upper terminal end of the canopy structure, as set forth in U.S. Pat. No. 290,315. FIG. 2 sets forth a further prior art table and seat organization 5, wherein a central table 6 utilizes a plurality of spaced tables 7 that are arranged and mounted relative to one another by an overlying framework, as illustrated in FIG. 2 and set forth in U.S. Pat. No. 4,621,865.

Figure 4:
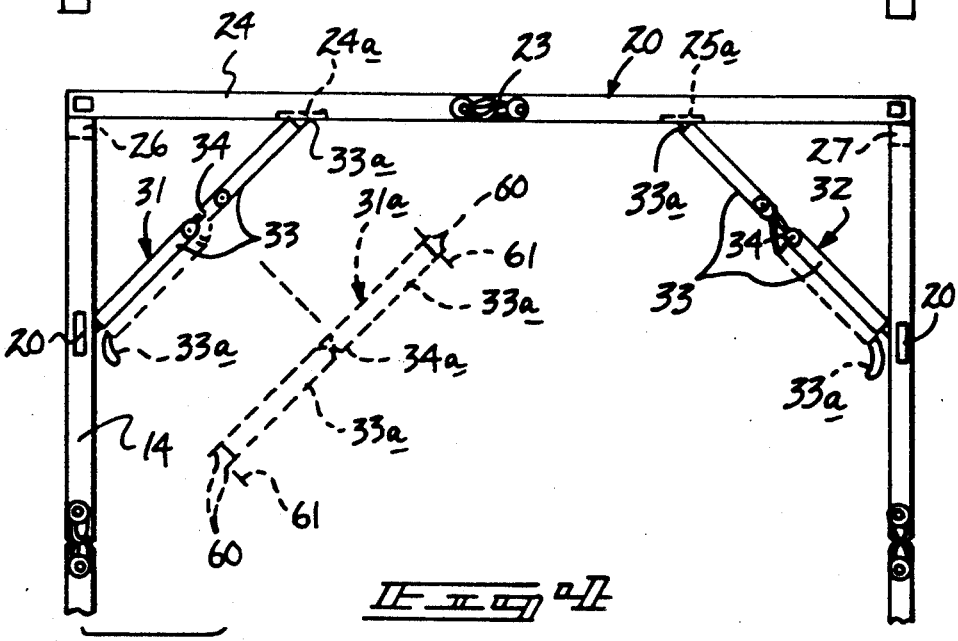
FIG. 4 is an orthographic side view, taken in elevation, of the side posts and top horizontal beam in association with a plurality of first diagonally arranged brace legs.
Figure 5:
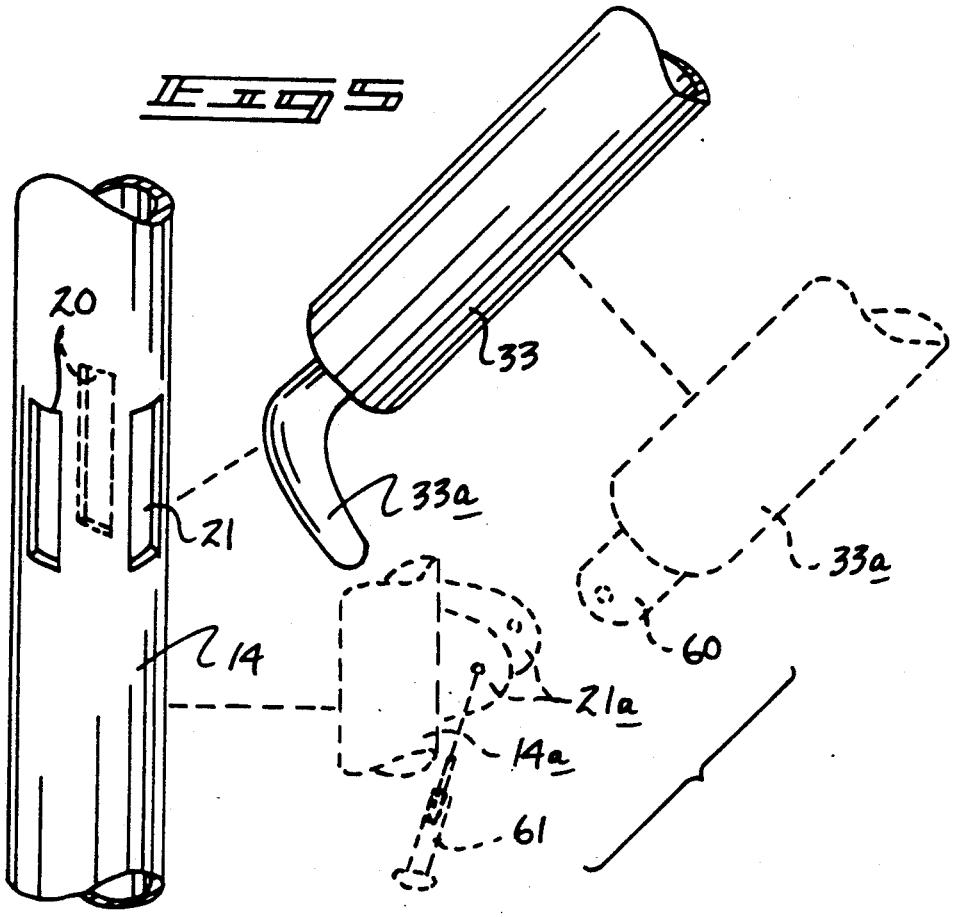
FIGS. 5 and 6 are isometric illustrations of the brace legs and their association with the post structure of the instant invention.
Figure 6:
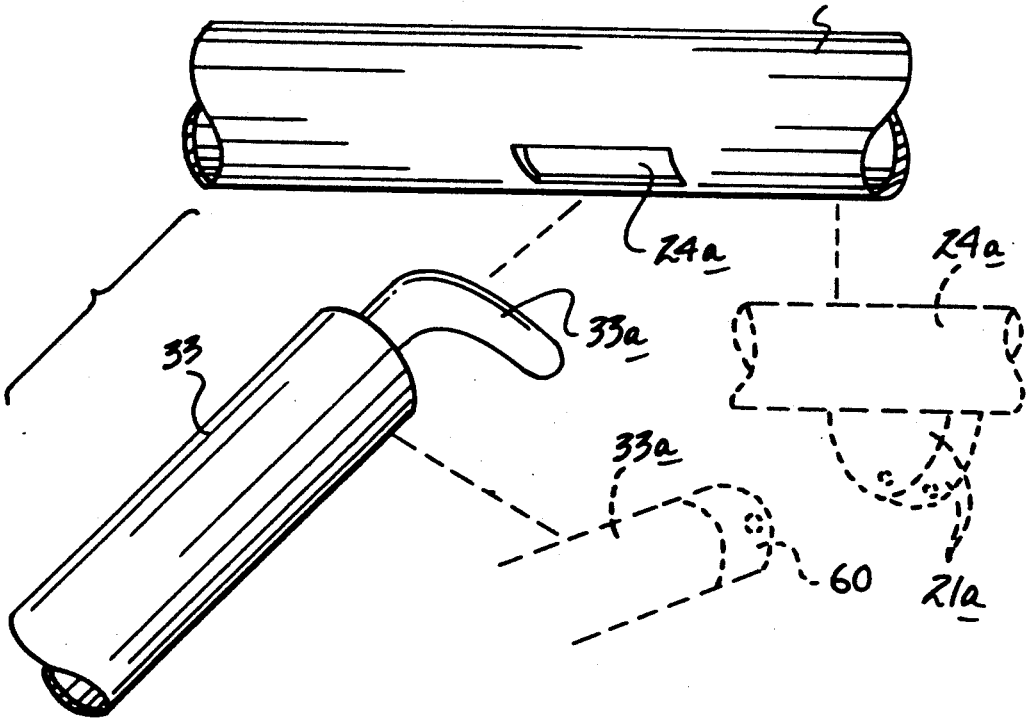

More specifically, the table and canopy apparatus 10 of the instant invention essentially comprises a left support post 11 and a right support post 12 that are interfoldable about a respective left and right locking pivot connection 17 and 18 to permit overfolding of each post from a downward configuration, as illustrated in FIG. 3, to a locked linear orientation. The left support post 11 includes a left lower and upper leg 13 and 14 respectively, with the right support post 12 including a right lower and upper leg 15 and 16, with the aforenoted pivot connection pivoting the upper and lower leg of each support post. The respective upper legs 14 and 16 are of a tubular configuration, as illustrated in FIG. 5 for example, to receive and lock the horizontal beam 22 therewithin. The horizontal beam 22 includes a horizontal beam medial locking pivot connection 23 that divides the horizontal beam 22 and demarcates a right and left horizontal beam leg 25 and 24. The right and left legs 25 and 24 include respective right and left leg slots 25*a* and 24*a* as illustrated in FIG. 4. The right and left leg slots 25*a* and 24*a* are in a confronting relationship relative to respective frontal brace slots 21 that are positioned forwardly of each upper leg 14 and 15 and are offset ninety degrees from respective pairs of diametrically aligned side slots 20 that are directed through the side walls of each tubular support post, as illustrated in FIG. 5. The respective right and left horizontal beam legs 25 and 24 include a respective left and right foot member 26 and 27, with each respective left and right foot member oriented ninety degrees relative to each of the leg slots 24*a* and 25*a* and are orthogonally oriented relative to outer terminal ends of each respective left and right legs 24 and 25. The foot members 26 and 27 are received within upper terminal ends of the upper legs 14 and 16. A respective left brace 31 and a right brace 32 project and are secured to the horizontal beam 20 and the respective left and right support posts 11 and 12. The left and right braces 31 and 32 are formed by a plurality of first brace legs 33, each including a medially positioned first central brace leg locking pivot connection 34 to lock the brace legs in a coaxially aligned orientation relative to one another, with each of the first brace legs 33 including a brace leg hook connector member 33*a* mounted at each outer terminal end of each first brace leg 33. The hook connector members 33*a* of the left brace 31 are received within the respective left leg slot 24*a* and the slot 21 of the left support post 11, as illustrated in FIG. 4, wherein similarly, the right brace 33 has its hook connector members 33*a* received within the right leg slot 25*a* of the horizontal beam 22 and the frontal brace slot 21 of the right support post 12. This provides for a rigid, rectangular frame, as illustrated in FIG. 4, when erected.

Figure 7:
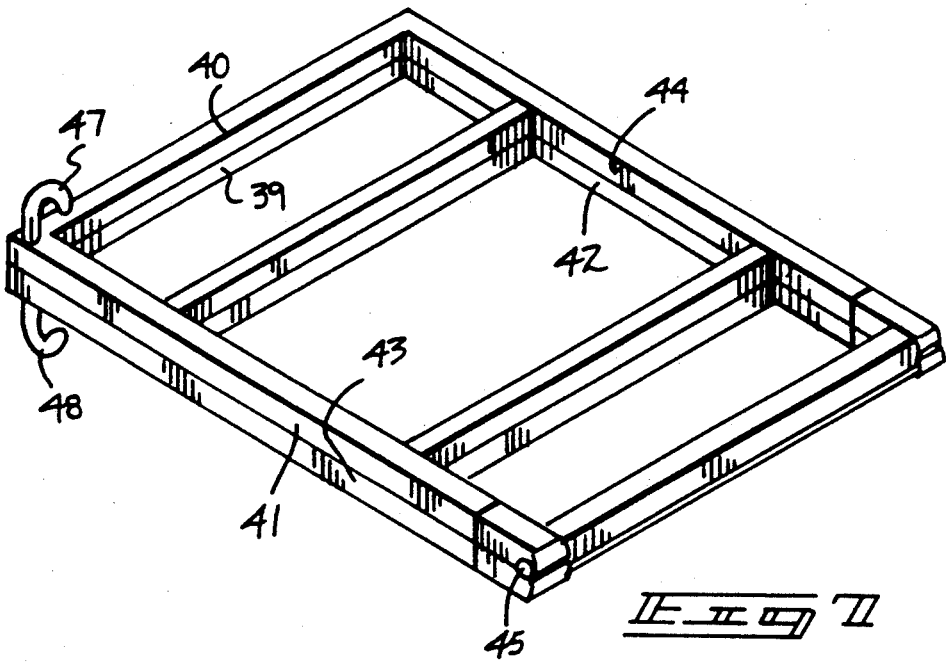
FIG. 7 is an isometric illustration of one of a plurality of rectangular frameworks in an overfolded configuration.
Figure 8:
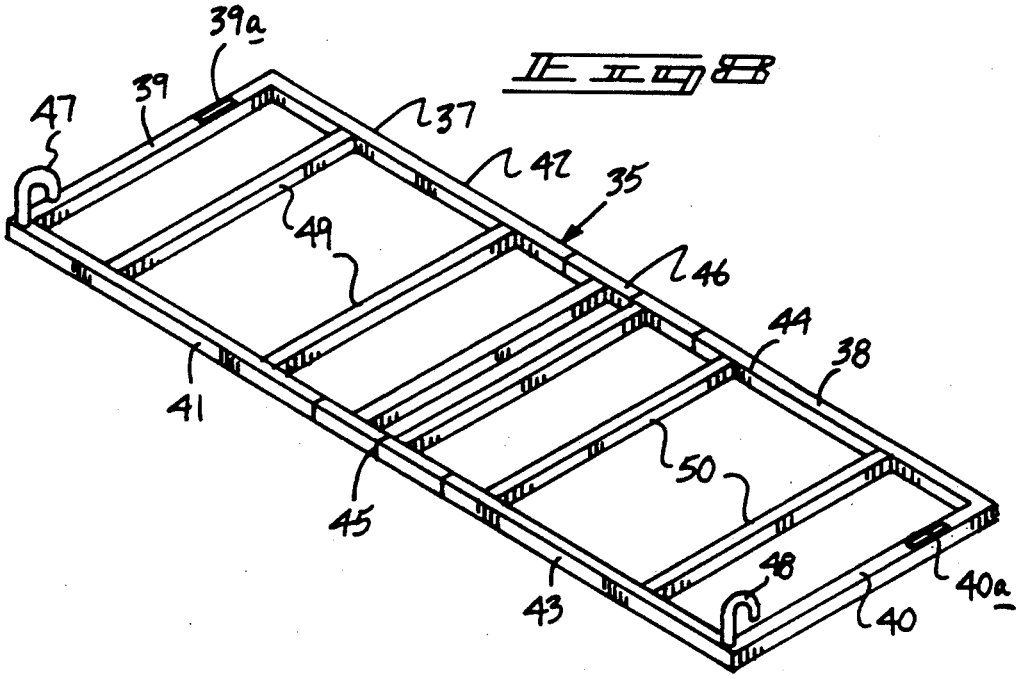
FIG. 8 is an isometric illustration of one of a plurality of rectangular frameworks in an extended and opened configuration.
Figure 9:
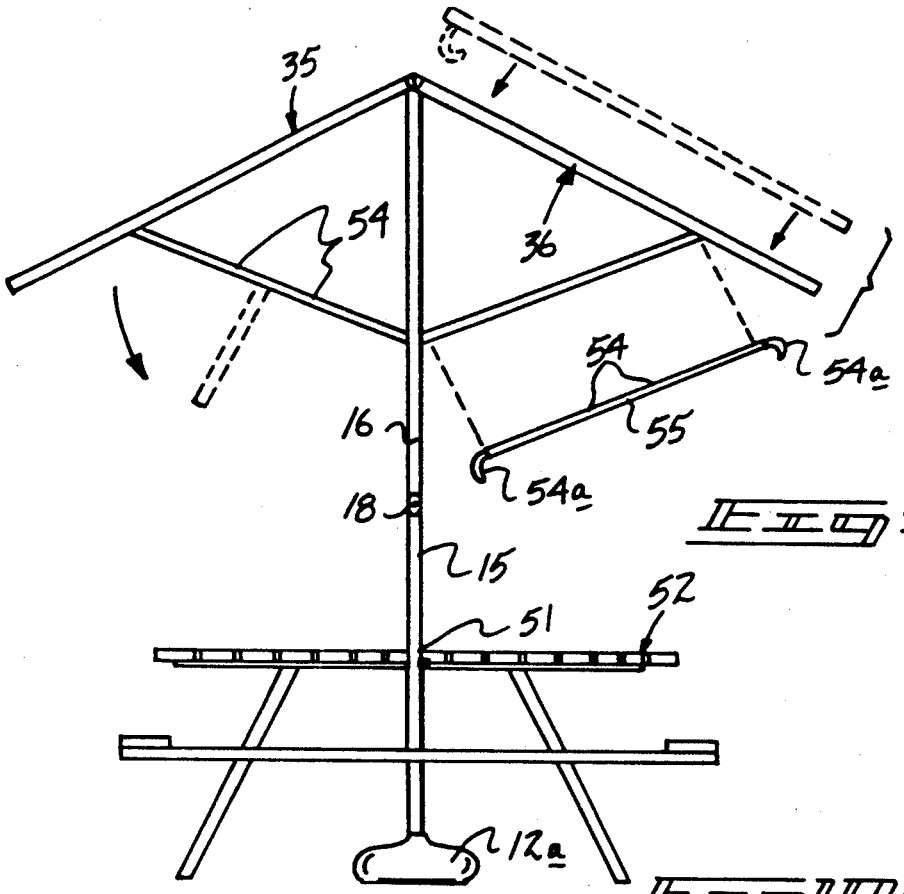
FIG. 9 is an orthographic side view, taken in elevation, of the instant invention.
Figure 10:
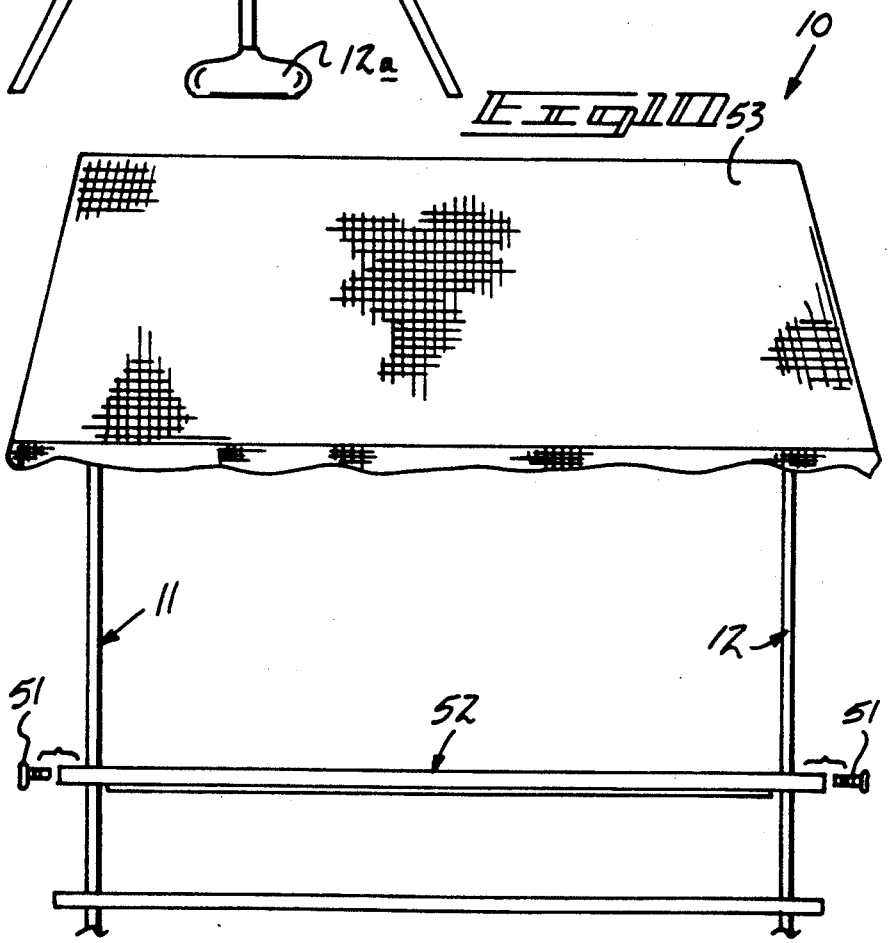
FIG. 10 is an orthographic side view, taken in elevation, of the instant invention in association with a fabric webbing overlying the rectangular frameworks.

FIGS. 7 and 8 illustrate a canopy framework set forth as a first canopy frame 35, wherein a second canopy frame 36 (see FIG. 9 for example) is utilized, wherein the first and second canopy frames 35 and 36 are of a rectangular configuration and are mounted coextensively to each side of the horizontal beam 22 defining an acute included angle therebetween. By way of example, the first canopy frame 35 is described, but it is understood that the second canopy frame is of identical construction and mounted in a mirror image arrangement onto the horizontal beam 22. The canopy frame 35 includes a first rectangular frame 37 pivotally mounted to a second rectangular frame 38. The first rectangular frame 37 includes a first exterior leg 39 that is arranged parallel to and spaced from a second exterior leg 40. The first exterior leg 39 includes a first exterior leg slot 39*a*, with the second exterior leg 40 including a second exterior leg slot 40*a*, wherein the slots are also arranged parallel relative to one another and aligned with one another relative to the first canopy frame 35. The rectangular frame 37 includes a first frame top leg 41 spaced from and parallel to a first frame bottom leg 42 that are each arranged orthogonally relative to the first exterior leg 39 at opposed terminal ends thereof and include a plurality of first frame ladder bars 49 directed parallel to the first exterior leg 39 and orthogonally relative to the first frame top and bottom legs 41 and 42. A respective top and bottom leg locking pivot connector 45 and 46 are mounted to pivotally secure terminal ends of the first frame top and bottom legs 41 and 42 to respective second frame top and bottom legs 43 and 44 that also include second frame ladder bars 50 that are orthogonally oriented relative to the second frame top and bottom legs 43 and 44 and parallel to the second exterior leg 40. A first frame mounting hook 47 is orthogonally mounted at an intersection of the first exterior leg 39 and the first frame top leg 41. Similarly, a second frame mounting hook 48 is mounted at a second intersection defined by the second top leg 43 and the second exterior leg 40. The first and second frame mounting hooks 47 and 48 include a hook portion that overlies the exterior legs, and wherein the first and second hooks 47 and 48 are each received within respective left and right horizontal beam slots 29 and 30 that are directed through the side walls of the horizontal beam 22 at outer terminal ends of each beam left and right leg 24 and 25, and overlie each respective right and left foot member 26 and 27 and are orthogonally oriented with respect to each foot member, as illustrated in FIG. 3 for example. Reception of the hooks of each frame 35 and 36 within a respective horizontal beam slot 29 and 30 permits erection of the canopy framework, as illustrated in FIG. 9. Further, second pairs of brace legs 54 are received within the first and second exterior let slots 39*a* and 40*a* of the exterior legs 39 and 40 respectively by projection of second brace leg hooks 54*a* therewithin. Further, each of the brace legs 54 are then received within a respective side slot 20 of each of the support posts 11 and 12 to mount and orient the canopy frames 35 and 36 in the orientation as illustrated in FIG. 9. Mounting bolts 51 are orthogonally projected through the lower legs 13 and 15 of the left and right support posts 11 and 12 to secure the support posts 11 and 12 orthogonally relative to a table member 52. Finally, the lower terminal ends of the left and right lower legs 13 and 15 are mounted within left and right support post bases 11*a* and 12*a* to provide a stable support mounting for each support post in its securement relative to the table member 52. Each canopy frame 35 includes a separate flexible covering web 53 surmounted thereover to provide shading, as well as affording protection from climactic elements, such as wind, rain, and the like during use, as illustrated in FIG. 10.

Additionally, FIG. 4 notes the use of a modified brace structure 31*a* that is utilized in lieu of the braces 31 and 32, as illustrated in FIG. 4. The modified brace structure is formed with the respective brace legs 33*a* mounted relative to one another by a medially positioned ratchet member to permit interfolding of the structure. The free terminal ends of each of the legs 33 are formed of with spaced flanges 60, wherein pins 61 are optionally utilized to mount the flanges 60 within the framework in lieu of the hook structure 33*a* of the left and right braces 31 and 32. FIG. 5 illustrates the organization wherein the flanges 60 are positioned within the ears 21*a* that are mounted on the modified post structure 14*a*. Pin 61 would accordingly fit between the flanges 60 and the ears 21*a* for mounting. In a like manner, the horizontal beam 24 utilizes ears 21*a* receivable within the flange 60, in a manner as illustrated in FIG. 5, utilizing the associated pin structure 61. It should be noted in a like manner, the brace structure 54, as illustrated in FIG. 9, may be configured in a like manner as the modified brace structure 33*a*.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A table and canopy apparatus comprising, in combination, an elongate table member, the table member including a left terminal end and right terminal end, and a respective left and right support post mounted to the respective left and right terminal ends, the left support post including a left lower leg pivotally mounted to a left upper leg, and the right support post including a right lower leg pivotally mounted to a right upper leg, and the left and right upper legs formed of a tubular configuration, and a horizontal beam mounted to the left and right upper legs, the horizontal beam including a horizontal beam left leg pivotally mounted to a horizontal beam right leg, and the horizontal beam left leg including a horizontal beam left foot member slidably receivable within the left upper leg, and the horizontal beam right leg including a horizontal beam right foot member received within the right upper leg, and the left foot member and right foot member orthogonally oriented relative to the respective horizontal beam left and right leg, and the horizontal beam having opposed sides, and the opposed sides of the horizontal beam coextensively therewith, and a respective first and second flexible covering web mounted to the respective first and second canopy framework, and the left upper leg and the right upper leg each includes a frontal brace slot, and the left and right upper legs each further include a pair of diametrically aligned side slots, the side slots orthogonally oriented relative to each respective frontal slot, and the horizontal beam left and right leg including a respective horizontal beam left and right leg slot, the horizontal beam left and right slot respectively oriented in confronting relationship relative to the left and right upper leg frontal slot, and a left first brace member and a right first brace member, the left and right first brace members each including a plurality of first brace legs, each of the first brace legs pivotally oriented relative to one another and securable in a coaxially aligned orientation, and the first brace legs of the left and right brace members each having a first and second terminal end and including a hook member fixedly mounted to each outer first and second terminal end of each of the left and right first brace legs, and the hook members of the left brace member mounted within the horizontal beam left leg slot and left upper leg of the left support post, and the hook members of the right brace member mounted within the horizontal beam right leg slot and the right upper leg of the right support post.

2. An apparatus as set forth in claim 1 wherein the first canopy frame and the second canopy frame each include a respective first and second rectangular frame pivotally mounted relative to one another, and the first rectangular frame includes a first exterior leg and the second rectangular frame includes a second exterior leg, wherein the first and second exterior legs are arranged parallel relative to one another and each include a respective first and second exterior leg slot, and each respective first and second exterior leg slot aligned with a respective side slot of each respective left and right support post, and a plurality of second brace members mounted to the left support post, and a further plurality of second brace members mounted to the right support post, wherein the second brace members are secured between the side slots and exterior leg slots of the first and second exterior legs and the left and right support posts.

3. An apparatus as set forth in claim 2 wherein the horizontal beam left leg includes a plurality of horizontal beam left leg slots, and the horizontal beam right leg includes a plurality of horizontal beam left leg slots, wherein the horizontal beam right leg slots are positioned adjacent the horizontal beam right foot member and offset ninety degrees relative thereto, and the horizontal beam left leg slots are positioned adjacent the horizontal beam left foot member and are offset orthogonally relative thereto, and each of the first and second canopy framework includes a plurality of first and second hooks, wherein the first hooks are positioned within a pair of horizontal beam right and left leg slots, and the second hooks are positioned within a further pair of horizontal beam left and right leg slots to coextensively mount the first and second canopy frames on opposed sides of the horizontal beam.

4. An apparatus as set forth in claim 3 wherein a respective left and right bolt member is directed through the respective left and right lower leg of the respective left and right support posts and received within the table member.

* * * * *